United States Patent [19]

Durr, Jr.

[11] 4,360,443

[45] Nov. 23, 1982

[54] STORAGE FIRE RESISTANT HYDRAULIC FLUID

[75] Inventor: Albert M. Durr, Jr., Ponca City, Okla.

[73] Assignee: Conoco Inc., Ponca City, Okla.

[21] Appl. No.: 262,589

[22] Filed: May 11, 1981

[51] Int. Cl.[3] ..... C09K 3/00

[52] U.S. Cl. ..... 252/76; 252/49.5; 252/73; 252/74; 252/75; 252/79

[58] Field of Search ..... 252/49.5, 79, 73, 74, 252/75, 76

[56] References Cited

U.S. PATENT DOCUMENTS 3,278,442 10/1966 Beebower et al. ..... 252/75

3,281,356 10/1966 Coleman ..... 252/49.5

*Primary Examiner*—Ralph S. Kendall

*Attorney, Agent, or Firm*—Cortlan R. Schupbach, Jr.

[57] ABSTRACT

A static storage stable fire resistant hydraulic fluid composition is provided which comprises (a) from about 40 to about 50 volume percent water together with (b) from about 50 to about 60 volume percent of a combination of (1) a lubricating oil (2) an emulsifier system containing succinic esters of hydrocarbon substituted succinic acid, polyhydric alcohols and alkaline earth salts of a fatty acid, and (3) at least one material selected from the group consisting of polyoxyethylene derivatives of alcohols and acids.

Most preferred materials are the ether derivatives of polyoxyethylene containing from 10 to 20 oxyethylene units formed from 10 to 20 saturated carbon atom normal alcohols. The most preferred material is the ether derivative of a polyoxyethylene containing 10 oxyethylene units formed from stearyl alcohol.

13 Claims, No Drawings

STORAGE FIRE RESISTANT HYDRAULIC FLUID

This invention relates to fire resistant hydraulic fluid compositions for use in systems for the transmission of mechanical energy by fluid pressure.

More specifically, this invention relates to new and useful invert (water in oil) emulsions and to such emulsions which are extremely storage stable over long periods of time while maintaining outstanding lubricating and hydraulic characteristics.

Invert or water in oil emulsions are well known to those skilled in the art. Representative but non-exhaustive of the art relating to such materials are U.S. Pat. Nos. 3,580,847; 3,177,146; 3,379,644; 3,278,442 and 3,532,632.

Conventional hydraulic fluids are petroleum oils which form an excellent fluid for hydraulic functions when properly formulated with suitable corrosion inhibitors, antioxidants, extreme pressure additives and the like. However, this fluid alone suffers from one major deficiency, which is flammability. Such flammability is more acute in applications where personnel are more closely exposed to or confined with hyraulic fluids, such as in coal mining operations. Considerable efforts have been directed toward the development of hydraulic fluids to replace such oils by developing fluids which retain the beneficial properties of the oil but which are essentially fire resistant.

Properly formulated oils are excellent hydraulic fluids. However, all petroleum oils have the drawback of being extremely flammable. Serious fires have been caused by hydraulic lines rupturing and the subsequent release under high pressure of the oil onto molten metal or hot exhaust systems, electrical wires or the like. This serious hazard has led industry and government to initiate programs for changing conventional hydraulic fluids to fire resistant hydraulic fluids. Such fluids are now in use, particularly in coal mines but also in various other obvious industrial applications.

Three types of fire resistant hydraulic fluids are known, including straight synthetic liquids of the organic phosphate ester type, water glycol fluids, generally based on polyethylene glycol, and water in oil invert emulsions. The first two types mentioned normally exhibit good lubricity and wear properties but are quite expensive and vary considerably in their fire resistant properties. The water in oil invert emulsions allow the oil to remain in a continuous phase so that the hydraulic fluids may retain and exhibit corrosion and lubricating properties of the oil, while the water phase provides resistance to flammability. However, merely emulsifying a petroleum oil with water fails to yield an emulsion of adequate lubricating qualities or stability, especially at high pressures. The problem of lubricity has been largely solved by reference to U.S. Pat. No. 3,281,356, hereby incorporated into the instant specification by reference in its entirety. This patent discloses a composition and emulsions formed from said composition which provide excellent lubricity.

However, a problem still remains in the use of such hydraulic fluids. One of these is that the emulsion tends to separate or migrate on storage. Migration or seperation is a phenomena in which the emulsion tends to stratify into layers of different densities and water content on standing. This is an undesirable property, since after a minimum storage time, initial withdrawals from storage system tend to be high in water (which tends to stratify at the lower levels of the container), thus leading to corrosion and low lubricity properties, followed by high wear. Once the excess water has been drained from the system, hydraulic fluid of excellent lubricity and wear characteristics is obtained, but which is much more flammable then desired. Therefore, it would be of great benefit to provide an emulsifier and a stable water-in-oil emulsion capable of resisting separation over long periods of storage while maintaining the benefits of the excellent water in oil emulsions of the prior art.

It is therefore an object of the present invention to provide improved emulsifiers and hydraulic fluids of the water in oil type which are fire resistant, have a minimum tendency to undergo separation in storage, resist separation and retain fire resistant characteristics. Other objects will become apparent to those skilled in this art as the description proceeds.

It has now been discovered that static storage stability of invert emulsions can be greatly improved by adding to the emulsions an effective amount of polyoxyethylene derivatives of various alcohols and organic acids. More specifically, such alcohols are polyoxyethylene derivatives containing from 2 to 20 oxyethylene units when adducted with saturated and unsaturated normal alcohols containing from 10 to 20 carbon atoms. These compounds are commonly named polyoxyethylene ethers. The acids are organic straight chain acids containing from 6 to 22 carbon atoms and which can be saturated or unsaturated. These acids contain polyoxyethylene adducts having from 2 to 20 oxyethylene units.

The polyoxyethylene ether used to produce stability in invert emulsions will depend upon the emulsifying system in use, as various ethers are more effective with varying emulsion systems, depending upon the solubility characteristics of the emulsifying system and the carbon atom content of the polyoxyethylene ether. The more commonly used commercial emulsifying systems contain compositions comprising a succinic ester of a substantially saturated hydrocarbon substituted succinic acid together with a polyhydric alcohol and minor amounts of an alkaline earth metal salt of a fatty acid. Such a system is described in U.S. Pat. No. 3,281,356 incorporated by reference into the instant specification. In general, these succinic esters are characterized by the presence of substituents on the succinic radical containing at least about 50 aliphatic carbon atoms. Succinic esters in which a substituent is derived from an olefin polymer having a molecular weight of between about 750 and about 5000 are preferred. However, those from olefin polymers of higher or lower molecular weight likewise are useful with those of the higher molecular weight being most useful.

Polyhydric alcohols useful in the most preferred emulsifying system contain from about 2 to about 6 alcoholic radicals, at least one of which must be unsubstituted. These alcohols can contain ether linkages within their molecular structure. Methods of preparation of these materials can be found in U.S. Pat. No. 3,281,356.

The alkaline earth metal salts of fatty acids useful in the present invention are those fatty acids having at least about 12 aliphatic carbon atoms in the fatty radical. More carbon atoms in the radical are normally used, but the specific fatty acid chosen will be based upon oil solubility and the effectiveness of the metal salts in maintaining the emulsions. In addition to the basic components of the system, promoting agents may be used such as alcohols or phenols. Preferred are phenol and alkylated phenols having from 1 to 3 alkyl substituents, each of which has up to about 50 carbon atoms. Mixtures of these materials can also be used.

The oil useful in the emulsion is any hydrocarbon oil having the required viscosity and lubricity necessary for the application in use. Mixtures of oils from different sources are also useful, such as mineral oils, vegetable oils, animal oils, synthetic oils of the polyolefin type, silicone type, polyester type and the like.

The invert emulsions of the present invention can contain from about 1 to about 80 parts of water and from about 20 to about 99 parts of oil by volume. However, emulsions having the most desirable properties contain from about 30 to about 50 parts of water and about 50 to about 70 parts of oil. Emulsions intended for use as fire resistant hydraulic fluids usually contain at least about 35% of water in oil, with water in oil ranging from about 40 to about 50% being most useful. The concentration of the succinic ester in the emulsion ranges from about 0.2 to about 10 parts, more often from about 1 to 5 parts per 100 parts of the emulsion. Concentration of fatty acid metal salt ranges from about 0.1 to about 5 parts usually from about 0.5 to about 3 parts per 100 parts of the emulsion.

Other additives are also useful in the basic emulsifying systems of the present invention. Useful in such emulsions are stabilizers such as phosphatides, aliphatic glycols, or monoaryl ethers of aliphatic glycols. Other useful emulsifier are monoalkyl ethers of aliphatic glycols and fatty acid esters of monoaryl or monoalkyl ethers of aliphatic glycols. In addition, alkali metal and ammonium salts of sulfonic acids can be used as emulsion stabilizers. These materials are usually utilized as supplementary emulsion stabilizers and also include neutral alkali metal salts of fatty acids having at least 12 aliphatic carbon atoms in the fatty radical. These stabilizers are usually used in very minor amounts such as 0.01 parts per hundred and rarely exceed about 2 parts per hundred parts of the emulsion.

High pressure agents such as lead, nickel, or Group II metal phosphorodithioates, chlorinated waxes sulfurized or phosphosulfurized fatty acid esters, phosphites and phosphates and metal dithiocarbamates can also be added to these emulsions.

The phosphites and phosphates usually are the diesters and triesters of phosphorous or phosphoric acid in which the ester radical is derived from the substantially hydrocarbon radical, as well as hydrocarbon radicals having further substituents such as halo, nitro, or ethers.

The metal dithiocarbamates are those of zinc, lead, strontium, nickel, cadmium, and the like wherein the alkyl radical contains from 3 to 30 carbon atoms. In addition, other materials such as rust inhibitors and the like can be added together with bactericides, oxidation inhibitors and so forth.

To this mixture is added a minor amount, generally from about 0.1 to about 5 parts by weight, preferably from about 0.5 to about 3.0 parts by weight of a polyoxyethylene derivative of an alcohol or a fatty acid. Generally, these materials are compounds derived from 10 to 20 carbon atoms, saturated and unsaturated normal alcohols, or 10 to 20 carbon atom carboxylic acids, otherwise termed fatty acids, adducted with from 2 to 20 oxyethylene units. Generally, the ether derivatives of polyoxyethylenes formed from 10 to 20 carbon atom saturated normal alcohols are useful. The most preferred compound is the ether derivative of a polyoxyethylene moiety and stearyl alcohol containing 10 oxyethylene units.

Representative but non exhaustive examples of alcohols used in the present invention when adducted with oxyethylene units are palmitic, stearic, oleic and linoleic. Representative but non exhaustive examples of acids useful in the present invention when adducted with oxyethylene units are palmitic, stearic, oleic and linoleic.

These materials normally are formulated with preservatives and stabilizers, but may of course be used alone. Particularly preferred preservative systems consist of butylated hydroxytoluene (BHT) and citric acid blended with polyoxyethylene ethers at a concentration of from about 0.001 weight percent to about 0.1 weight percent.

Representative but non-exhaustive examples of the invert emulsion stabilizers for static storage of the present invention are polyoxyethylene oleyl ethers, polyoxyethylene cetyl ethers, polyoxyethylene glycol fatty esters, polyoxyethylene lauryl ether, polyoxyethylene stearyl ether, polyoxyethylene olelyl ether, polyoxyethylene tridecyl ether, polyoxyethylene stearate, polyoxyethylene palmitate, and polyoxyethylene cetate.

While all these materials are described as containing from 2 to 20 polyoxyethylene units, the most preferred polyoxyethylene-containing range is from about 8 to about 14, with polyoxyethylene units of from 10 to 12 being most preferred. The most preferred materials are those containing 10 polyoxyethylene units.

Emulsifier systems are prepared by mixing the necessary equivalents of the succinic acid esters, the alkaline earth metal salt of a fatty acid mixture (such as sperm oil) and the polyhydric alcohol, refluxing for a time sufficient to form reaction products, drying, and then carbonating as described in U.S. Pat. No. 3,281,356 to obtain the emulsifier. The invert emulsion can then be prepared by simply mixing oil, succinic ester, the fatty acid metal salt and other additives desired in a homogenizer or other efficient blending device followed by addition of the water with sufficient blending and homogenation. Usually any heating or reaction is not necessary. In addition, the order of mixing the ingredients is not critical, although it is most convenient to first prepare an oil concentrate containing from about 50 to about 95 parts of the oil soluble ingredients and from about 5 to 50 parts of oil and then to emulsify the concentrate with water in appropriate proportions.

The polyoxyethylene materials of the present invention can be added conveniently either at the time of blending the concentrate with oil and water, or by adding to the emulsifier concentrate containing succinic acid esters, polyhydric alcohols and alkaline earth metal salts of fatty acids. Normally the reaction of the emulsifying system will be carried out before blending with the materials of the present invention. However, this is not believed critical.

When completed, the inverted emulsion produced by the process of the present invention provides a long term static storage stable fire resistant fluid which maintain excellent lubricating properties. The additives of the present invention, in fact, do not appreciably effect the wear or corrosion characteristics of the system to which it is added. The additives of the present invention produce an invert emulsion which is indistinguishable from the material to which it is added except in the improvement in storage stability. In addition, the use of the present invention may allow a reduction in the amount of emulsifier used, allowing the use of higher amounts of entrained water and/or the reduction of cost in the total system.

The instant invention is more concretely described with reference to the examples below wherein all parts and percentages are by weight unless otherwise specified. Examples are provided to illustrate the present invention and not to limit it.

EXAMPLE 1

Five gallon samples of several of commercial fire resistant hydraulic fluids were obtained as sold commercially. These products were stirred for 1 hour with a high speed stirrer. Samples were stored for 5 days at ambient temperature and 2 days at 40° F. per testing cycle. Test cycles were 30 day intervals. Sample A was Ultraguard 500, trademark of and sold by Michael Walters Company; Sample B was Pyrogard D, trademark of and sold by Mobil Oil Company; Sample C was Maxmul Hydraulic Fluid, F. R., trademark of and sold by Pennzoil Corporation; Sample D was Hulsafe 600, trademark of and sold by Hulbert Corporation; Sample E was Conoco F. R. Hydraulic Fluid, trademark of and sold by Conoco Inc.

All commercial products showed a high increase in water content of the lower ⅓ of the samples over the storage period. This experience is typical of current commercially available fire resistant hydraulic fluids. Results of this 6 months comparative static storage test is set forth in Table 1.

TABLE 1

| | STORAGE STABILITY WATER CONTENT, VOLUME % | | | | | | | | | | |
|---|---|---|---|---|---|---|---|---|---|---|---|
| | | 30 Days | | 60 Days | | 90 Days | | 120 Days | | 180 Days | |
| Sample | 0 Days Original | Upper ⅓ | Lower ⅓ | Upper ⅓ | Lower ⅓ | Upper ⅓ | Lower ⅓ | Upper ⅓ | Lower ⅓ | Upper ⅓ | Lower ⅓ |
| A | 38 | 38 | 38 | 36 | 38 | 32 | 53 | 22 | 69 | 16 | 91 |
| B | 44 | 43 | 45 | 43 | 44 | 42 | 45 | 30 | 47 | 26 | 64 |
| C | 41 | 43 | 43 | 41 | 43 | 41 | 50 | 36 | 52 | 23 | 63 |
| D | 39 | 39 | 39 | 39 | 39 | 39 | 45 | 35 | 46 | 19 | 60 |
| E | 39 | 40 | 40 | 39 | 46 | 34 | 68 | 12 | 75 | 10 | 76 |

Thus it is apparent that the long term storage stability deficiency is exhibited by currently manufactured products. The present invention is designed for use with and to complement emulsifier additive package for preparing such fire resistant hydraulic fluid. Generally, such fire resistant hydraulic fluids are regarded as unsuitable for use when the upper portion exhibits more than 35 volume percent water and the lower portion exhibits more than 50 volume percent water. These conditions are met by most commercial products which stratify excessively and become unuseable after 3 to 4 months static storage.

In order to directly compare the effects of the additives of the present invention upon standard fire resistant hydraulic fluids, a control sample was prepared and utilized throughout the remainder of the testing described in the present invention. This control system was formed by adding 8.40 weight percent of a commercial emulsifier containing the succinic ester of hydrocarbon substituted succinic acid, polyhydric alcohols, and an alkaline earth metal salt of a fatty acid (LUBRIZOL 5162 Trademark of and sold by the Lubrizol Corp. Cleveland, Ohio) to 91.60 weight percent hydraulic oil to form a concentrate. This concentrate was combined with water in a ratio of 58 volume percent hydraulic oil and about 42 volume percent water. The control sample of fire resistant hydraulic fluid was prepared by charging the oil-emulsifier concentrate to an appropriately sized mixing vessel fitted with a high speed mixer, followed by the addition of water with a postmixing period of approximately 15 minutes.

As a direct comparison, a second sample was prepared exactly as described above except that to the concentrated commercial emulsifier used, was added 9.2 percent by weight of polyoxyethylene (10) stearyl ether (Brij 76, Trademark of and sold by ICI America's Inc.) based on the concentrate weight. The fire resistant hydraulic fluid was prepared exactlly as described in the control sample to obtain the comparative test partner.

EXAMPLE 2

A static storage test was initiated wherein samples of the control and the material of the present invention were actively stirred for 1 hour, then placed in glass separatory funnels and allowed to stand. Samples were taken from the upper ⅓ and the lower ⅓ of each sample at monthly intervals and the water content of each sample was determined. The results of this static storage stability comparison is set forth in Table 2.

TABLE 2

| | STATIC STORAGE STABILITY | | | |
|---|---|---|---|---|
| | CONTROL PLUS ADDITIVE SYSTEM WATER CONTENT, VOL % | | CONTROL WATER CONTENT, VOL % | |
| Storage Period (months) | Upper ⅓ Portion | Lower ⅓ Portion | Upper ⅓ Portion | Lower ⅓ Portion |
| 0 | 42 | 42 | 42 | 42 |
| 1 | 42 | 42 | 42 | 42 |
| 2 | 43 | 43 | 42 | 43 |
| 3 | 42 | 42 | 39 | 47 |
| 4 | 42 | 42 | 38 | 48 |
| 5 | 42 | 42 | 33 | 66 |
| 6 | 42 | 42 | 18 | 73 |
| 7 | 42 | 42 | 10 | 75 |
| 8 | 42 | 43 | 12 | 84 |
| 9 | 42 | 42 | 10 | 80 |
| 10 | 42 | 42 | 9 | 80 |
| 11 | 42 | 42 | 7 | 80 |
| 12 | 42 | 42 | 11 | 77 |
| 13 | 41 | 41 | 7 | 79 |
| 14 | 40 | 41 | 7 | 80 |
| 15 | 41 | 40 | 5 | 81 |
| 16 | 41 | 40 | 6 | 82 |
| 17 | 41 | 41 | 5 | 82 |
| 18 | 41 | 39 | 5 | 81 |

Several other testes were employed for estimating the quality of the inert fire resistant hydraulic fluids containing the additives of the present invention.

EXAMPLE 3

Control samples and samples of the present invention were prepared as described in Example 2 and emulsified such that 90% of the samples were less than 3 microns in size with in 24hours after preparation. Particle size after 7 days storage was 90% less than 5 microns using the additive system of the present invention whereas 90% is less than 20 microns using the control test.

EXAMPLE 4

An oven storage test was carried out on both the control and the material of the present invention as prepared in Example 2 wherein the comparative samples were stored in an oven at 85° C. for 72 hours. At the end of this time the free oil and free water content each was determined. The samples were very comparable in that both exhibited nearly the same results. The results are set forth in Table 3.

TABLE 3

| OVEN STORAGE TEST @ 85° C. | Control Plus Additive | Control |
|---|---|---|
| Free Oil, Vol % | 2.0 | 3.0 |
| Free Water, Vol % | .05 | .05 |

EXAMPLE 5

Samples prepared as described in Example 2 were placed in oven storage at 75° C. for 30 days. Again the results of oven storge stability were very similar for both samples. The results are set forth in Table 4.

TABLE 4

| OVEN STORAGE TEST (30 Days @ 75° C.) | Control Plus Additive | Control |
|---|---|---|
| Free Oil, Vol % | 22 | 22 |
| Free Water, Vol % | .05 | .05 |

EXAMPLE 6

A freeze-thaw cycling test was initiated for samples prepared as described in Example 2 at a temperature of −18° C. and carried out for 10 freeze-thaw cycles. The results are set forth in Table 5 wherein percent free oil and water is defined as that percentage of the total sample which contain no appreciable amount of the other phase as determined by visual observation in a graduated container of 100cc (cubic centimeters) capacity. In the table, the heading "Flow" is simply a visual observation as to whether flow was affected by the freezing cycle.

TABLE 5

FREEZE-THAN TEST (−18° C., 10 Freeze-Thaw Cycles)

| | Control plus Additive | | | Control | | |
|---|---|---|---|---|---|---|
| Cycle | Free Oil, % | Free Water, % | Flow | Free Oil, % | Free Water, % | Flow |
| 1 | 0 | 0 | No Effect | 0 | 0 | No Effect |
| 2 | 0 | 0 | " | 0 | 0 | " |
| 3 | 0 | 0 | " | 0.25 | 0 | " |
| 4 | 0 | 0 | " | 1.0 | 0 | " |
| 5 | 0 | 0.5 | " | 1.0 | .025 | " |
| 6 | 1.0 | 0.10 | " | 1.5 | .025 | " |
| 7 | 1.0 | 0.10 | " | 1.5 | .05 | " |
| 8 | 1.0 | 0.20 | " | 1.5 | .05 | Slow Flow |
| 9 | 1.0 | 0.40 | " | 1.5 | .25 | " |
| 10 | 1.0 | 0.40 | " | 1.5 | .25 | " |

EXAMPLE 7

Vane pump wear tests were carried out on blends formed from the control and the control plus the additive. Tests were carried out following the procedure set forth in ASTM method D-2882.The pump pressure utilized was 15,000 pounds per square inch to minimize pump breakage.

In the tests carried out, three blends were prepared. Blend 1 was the control material containing 4.65 weight percent of the emulsifing package. Blend 2 was a 4.65 weight percent of the emulsifier package plus 0.55 percent of the additive of the instant invention. Blend 3 was 3.94 weight percent of the control package plus 0.38 percent of the additive of the percent invention. At the conclusion of the tests wear results were determined. The test results are set forth in Table 6.

TABLE 6

| Blend # | Ring | Vane | Total |
|---|---|---|---|
| 1 | 165.2 | 1.3 | 166.5 |
| 2 | 6.3 | 0.9 | 7.2 |
| 1 | 72.4 | 1.5 | 73.9 |
| 3 | 27.8 | 0.5 | 27.8 |
| 1 | 154.3 | 5.0 | 159.3 |
| 2 | 65.6 | 52.6 | 118.2 |

The average wear for the three blend 1's tested was 133.2 miligrams of wear. The average wear for the two tests of blend 2 plus 3 was 51 milligrams of wear, indicating the excellent lubiricty of the additives of the present invention even at the low levels of use.

When the additives of the present invention are added to the invert emulsion systems as concentrates, that is, prior to admixture with water and lubricating oil, occasionally some separation will be noted. In these cases, it is advisable to add a small amount of water on low carbon atom alcohol to the mixture to maintain the concentrate in stable suspension with the emulsifier system and additives. However, these materials may be added separately to the water and lubricating oil to form a finished emulsion. In either case, the finished emulsion is thereafter stable for at least 18 months.

The additives of the present invention are useful in the pure form or in admixture with low amounts of perservatives. When obtained commercially, for example, polyoxyethylene (10) stearyl ether normally contains low amounts of antioxidants such as butylated hydroxytoluene and citric acid. These materials are in no fashion detract from the effectiveness of the system.

Thus the present invention comprises a composition containing succinic esters of hydrocarbon substituted succinic acid in the amount of from about 0.2 to about 10 parts together with a polyhydric alcohol and from about 0.1 to about 5 parts of an alkaline earth metal salt of a fatty acid having at least about 12 aliphatic hydrocarbon atoms in the fatty radical, the improvement comprising adding from about 0.1 to about 5 parts of at least 1 material selected from the group consisting of polyoxyethylene ethers containing from 2 to 20 oxyethylene units derived from saturated and unsaturated normal alcohols and acids. These materials are useful in forming hydrocarbon lubricating oil composiitons which are flame retardant.

The finished hydrocarbon water and oil emulsion lubricating oil composition likewise can contain from about 0.1 to about 5 parts of zinc phosphorodithioate and from about 0.1 to about 5 parts of aliphatic primary amines in which the aliphatic radical is a tertiary alkyl radical having from 8 to 30 carbon atoms and also contains from about 0.01 to about 5 parts of a phosphatide.

Normally such stable water and oil emulsions contain from about 1 to about 80 parts of water and from about 20 to about 99 parts of mineral oil together with from about 0.35 to about 10 parts of the emulsifier of the present invention.

In addition, the stable water in oil emulsion can likewise contain at least about 0.1 equivalents of polyoxyethylene sorbitanmonooleate.

Preferably, the stable water and oil emulsion useful as a lubricant and a hydraulic fluid will comprise essentially from about 20 to about 50 parts of water, from about 50 to about 80 parts of a mineral oil, and from about 1 to about 5 parts of the succinic esters together with about 0.5 equivalents of polyoxyethylene, sorbitan, monooleate from about 0.1 to about 0.5 parts of a basic barium salt of a fatty acid containing about 18 carbon atoms in the fatty radical and from about 0.1 to about 2 parts of zinc diisooctylphosphorodithioate, from about 0.1 to about 3 parts of soybean lecithin, and from about 0.1 to about 1 parts of tertiary alkyl primary amines wherein the tertiary alkyl radical is a mixture of radicals containing from about 11 to about 14 carbon atoms.

Thus it is readily apparent that the present invention is an improvement over the prior art in that polyoxyethylene ethers have been discovered to maintain static storage stability for periods of time ranging up to 5 times that of the prior art while maintaining all of the advantageous properties of the prior art material.

While certain embodiments and details have been shown for the purpose of illustrating this invention, it will be apparent to those skilled in this art that various changes and modifications may be made herein without departing from the spirit or scope of the invention.

I claim:

1. A composition for forming an oil in water emulsion consisting essentially of from about 0.2 to about 10 parts of a succinic ester of a hydrocarbon substituted succinic acid having at least about 50 aliphatic carbon atoms in the substituent, a polyhydric alcohol from about 0.1 to 5 parts of an alkaline earth metal salt of a fatty acid having at least about 12 aliphatic carbon atoms in the fatty radical and from about 0.1 to about 5.00 parts of at least one material selected from the group consisting of polyoxyethylene ethers containing from 8 to 14 oxyethylene units derived from saturated and unsaturated normal alcohols containing from 10 to 20 carbon atoms and organic acids containing from 6 to 22 carbon atoms when adducted with from 8 to 14 oxyethylene units.

2. a stable water and oil emulsion suitable for use as a lubricant and a flame resistant hydraulic fluid consisting essentially of from about 1 to about 80 parts of water, from about 20 to about 99 parts of mineral oil, from about 0.2 to about 10 parts of a succinic ester of a hydrocarbon substituted succinic acid having at least about 50 aliphatic carbon atoms in the substituent, polyhydric alcohol from about 0.1 to 5 parts of an alkaline earth metal salt of a fatty acid having at least about 12 aliphatic carbon atoms in the fatty radical and from about 0.25 to about 1.00 parts of at least one material selected from the group consisting of polyoxyethylene ethers containing from 8 to 14 oxyethylene units derived from saturated and unsaturated normal alcohols containing from 10 to 20 carbon atoms and organic acids containing from 6 to 22 carbon atoms when adducted with from 8 to 14 oxyethylene units.

3. An emulsion as described in claim 2 wherein the alkaline earth metal salt of the fatty acid has a metal ratio of from about 1 to about 20.

4. An emulsion as described in claim 3 wherein in addition from about 0.05 to about 5 parts of zinc phosphorodithiooate is added.

5. An emulsion as described in claim 4 wherein the emulsion contains from about 0.1 to about 5 parts of an aliphatic primary wherein the aliphatic radical is a tertiary alkyl radical containing from about 8 to about 30 carbon atoms.

6. An emulsion as described in claim 5 wherein the emulsion contains from about 0.01 to about 5 parts of a phosphatide.

7. An emulsion as described in claim 6 wherein the emulsion in addition contains from about 0.05 to about 5 parts of a zinc phosphorodithiooate.

8. A stable water and oil emulsion consisting essentially of from about 20 to about 50 parts of water, from about 50 to about 80 parts of a mineral oil, from about 1 to about 5 parts of a succinic ester of a hydrocarbon substituted succinic acid having at least about 50 aliphatic carbon atoms in the substituent, a partially acylated polyhydric alcohol from about 0.1 to about 5 parts of an alkaline salt of a fatty acid having at least about 12 aliphatic carbon atoms in a fatty radical and having a metal ratio of from about 1 to about 20 and from about 0.1 to about 5.00 parts of at least one material selected from the group consisting of polyoxyethylene ethers containing from 8 to 14 oxyethylene units derived from saturated and unsaturated normal alcohols containing from 10 to 20 carbon atoms organic acids containing from 6 to 22 carbon atoms when adducted with from 4 to 14 oxyethylene units.

9. A stable water and oil emulsion as described in claim 8 wherein the emulsion contains in addition at least 0.1 equivalents of polyoxyethylene, sorbitanmonooleate.

10. An emulsion as described in claim 9 wherein the emulsion contains in addition from about 0.1 to about 3 parts of a tertiary alkyl primary amine having from about 11 to about 14 carbon atoms in the alkyl radical and from about 0.1 to about 3 parts of a phosphatide.

11. An emulsion as described in claim 10 wherein the emulsion contains in addition from about 0.1 to about 2 parts of zinc phosphorodithioate.

12. An emulsion as described in claim 11 wherein the emulsion contains in addition from about 0.1 to about 3 parts of soybean lecithin.

13. An emulsion as descirbed in claim 12 wherein the emulsion contains in addition from about 0.1 to about 2 parts of zinc diisooctylphosphorodithioate.

* * * * *